United States Patent [19]

Quaggiotti

[11] Patent Number: 4,878,686

[45] Date of Patent: Nov. 7, 1989

[54] DOUBLE-SHOE SKI WITH INTERMEDIATE LINKING MEMBER

[75] Inventor: Vittorio Quaggiotti, Padova, Italy

[73] Assignee: S.B.P. S.r.l., Padova, Italy

[21] Appl. No.: 75,786

[22] Filed: Jul. 20, 1987

[30] Foreign Application Priority Data

Aug. 22, 1986 [IT] Italy ..... 41601 A/86

[51] Int. Cl.[4] ..... A63C 5/00

[52] U.S. Cl. ..... 280/602; 280/609; 280/15; 280/16

[58] Field of Search ..... 280/606, 602, 609, 11.15, 280/12 K, 21 R, 28, 15, 16

[56] References Cited

U.S. PATENT DOCUMENTS

| | | | |
|---|---|---|---|
| 465,641 | 6/1943 | Sarthou | 280/606 |
| 1,498,992 | 6/1924 | Blomstrand | 280/16 |
| 2,390,181 | 12/1945 | Sarthou | 280/606 |
| 3,014,731 | 12/1961 | Dworak | 280/28 |
| 3,450,413 | 6/1969 | Brenter | 280/16 |
| 3,561,783 | 2/1971 | Ellett | 280/16 |
| 3,638,960 | 2/1972 | Eaton | 280/16 |
| 4,109,739 | 8/1978 | Husted | 280/28 |
| 4,487,426 | 12/1984 | Nishizawa | 280/609 |

FOREIGN PATENT DOCUMENTS

| | | | |
|---|---|---|---|
| 184000 | 6/1986 | European Pat. Off. . | |
| 2010382 | 9/1971 | Fed. Rep. of Germany . | |
| 7235324 | 5/1973 | Fed. Rep. of Germany . | |
| 737471 | 12/1932 | France | 280/16 |
| 1424723 | 12/1965 | France | 280/602 |
| 2423243 | 11/1979 | France . | |

*Primary Examiner*—Charles A. Marmor
*Assistant Examiner*—Tamara L. Finlay
*Attorney, Agent, or Firm*—Beveridge, DeGrandi & Weilacher

[57] ABSTRACT

A double-shoe ski comprising a front shoe and a rear shoe aligned according to their longitudinal axis; an intermediate floating arm linking together the two shoes.

Compression spring members are disposed between said linking arm and the shoes of the ski.

15 Claims, 3 Drawing Sheets

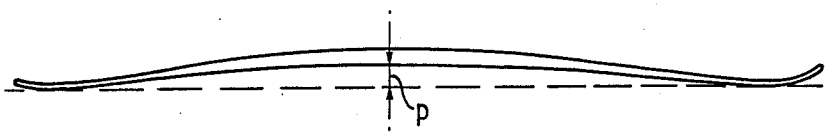
Fig. 1- PRIOR ART
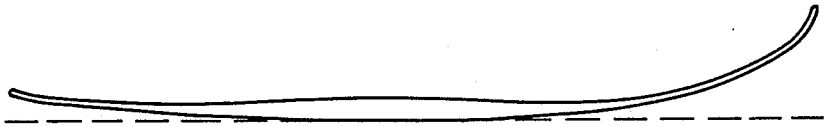
Fig. 2- PRIOR ART
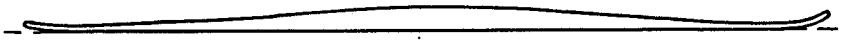
Fig. 3-PRIOR ART
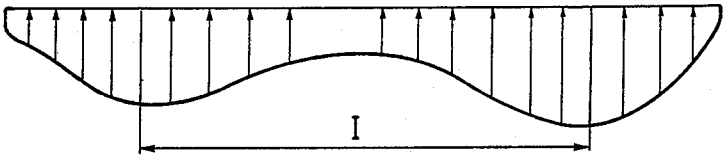
Fig. 4-PRIOR ART
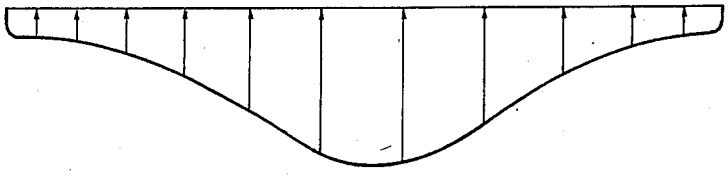
Fig. 5-PRIOR ART
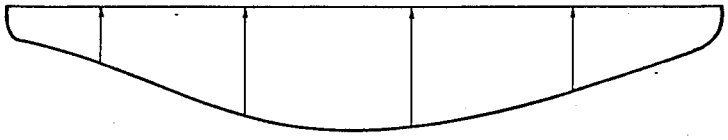
Fig. 6-PRIOR ART

DOUBLE-SHOE SKI WITH INTERMEDIATE LINKING MEMBER

BACKGROUND OF THE INVENTION

As is known conventional skis are suitably arched and have a downward facing convex surface whose camber is referred to as "rise", in order to give the ski sufficient grip, that is, to ensure that it slides evenly and continuously over the ground, without side-slipping or pendular oscillations, both on the straight and on relatively wide-radius curves.

If, in fact, a ski has a high "rise" and, simultaneously, a high degree of flexural rigidity, the reaction load, due to the ground on which it is pressed and "flattened" by the weight of the skier, has a distribution which is highly concentrated at the ends, with separate relative maximum loads spaced considerably far apart.

This distribution, in fact, permits greater incision of the edges at the ends and, therefore, ensures greater stability.

It is also known, moreover, that when curving with parallel skis, each ski, and especially the outside one, must be able to bend in the reverse direction, especially in the front area towards the shovel. In fact, since it is also placed "edgewise", or slanting towards the inside of the curve (as a result of the analagous centripetal displacement of the barycentre of the skier and, earlier still, as a result of the "angulation" that he assumes by bending his legs and the top half of his body sideways), its "reverse bending", together with the natural lateral concavity of its plan profile enables the inside edge provided with a metal strip, to assume a deformed attitude identical to the curve.

But, in order to enable the skier to carry out this manoeuver easily (especially at the initial stage, during the "reversing of the edge", the ski should, on the contrary, have a low "rise" and a very limited flexural rigidity. It should be made in such a way as to submit to the reaction of the ground with the load concentrated to a great extent at the center.

For the conventional ski therefore, the situation is intrinsically contradictory, as far as its elastic properties are concerned. And so, the general tendency is to seek a compromise solution by shifting slightly in one direction or the other according to use or to the user for whom the ski is presumably destined and, moreover, according to the most up-to-date trends, tending mainly towards flexibility with sufficient flexural deformation as to give rise to a rather uniform distribution of the reaction load but with a single peak close to the center of the ski.

In this respect, manufacturers have perfected relatively sophisticated techniques, with multicomposite sandwich structures, in order to develop elastic properties aimed at achieving solutions capable of encouraging such compromise, by resorting to skis having a very high degree of rigidity over quite a wide area around the center line while having a considerably high degree of flexibility at the ends, especially towards the shovel;

skis having a very high degree of torsional rigidity in relation to flexural rigidity, that is to say, skis having a high ratio between said rigidities, especially towards the shovel.

Both these properties in fact give the ski quite good stability, both on the straight and in wide-radius curves, with reasonably satisfactory resistance to side-slipping and progressive driving, while at the same time permitting a certain amount of ease of movement in "reversing the edge" when approaching each subsequent curve.

This structural tendency however involves complex and costly technologies (sandwiches with numerous differential layers, including two preferably fine metal layers reinforced by adjacent layers in fiber or plastic), and it is nevertheless a compromise solution with which it is not possible to radically overcome the contradiction mentioned previously, which remains an intrinsic and physiological characteristic of the conventional "single continuous" bar structure of the ski.

This invention constitutes the logical outcome of this analysis and aims to radically overcome the aforesaid contradiction by providing a new ski structure capable of automatically adapting to the load conditions and in which the distribution of the reaction load can vary with variations in the conditions of use of the ski itself.

A further scope of this invention is to provide a ski of the aforementioned type, which can be inexpensively mass-produced, while at the same time keeping very high standard of quality.

SUMMARY OF THE INVENTION

According to the invention, a double-shoe ski has been provided comprising a rear shoe and a front shoe aligned according to their longitudinal axis, and an intermediate link member between the two shoes, said link member being hinged to at least on of the aforesaid shoes of the ski, and an elastic member disposed between said link member and the aforesaid at least one shoe.

BRIEF DESCRIPTION OF THE DRAWINGS

The structural and operating characteristics of the ski according to the invention, compared to a conventional ski, are described in greater detail hereunder, with reference to the accompanying drawings, in which:

FIG. 1 shows the profile of a conventional ski, in the non-loaded condition;

FIG. 2 shows the same ski of FIG. 1 in a highly deformed counterflexed condition;

FIG. 3 shows the same ski of FIG. 1 in a flattened condition;

FIG. 4 shows the distribution of the reaction load of a conventional rigid ski with a high rise;

FIG. 5 shows the distribution of the reaction load of a conventional ski with limited rise;

FIG. 6 shows the distribution of the reaction load in a conventional "compromise" ski;

DESCRIPTION OF THE INVENTION

FIGS. 1 to 6 show different situations for a conventional ski, the characteristics of which are compared further on with the ski according to this invention.

In particular, FIG. 1 shows the natural profile of a conventional ski, in the non-loaded condition, in which reference p has been used to indicate the "rise" or maximum camber at the center line of the ski. FIG. 2, on the contrary, shows the profile of the same ski highly deformed in the opposite direction, especially at the front part of the ski when curving with the skis parallel, as mentioned previously, while FIG. 3 shows the same ski loaded by the weight of the skier and flattened against the ground. In this latter condition, in the case of skis having a high rise and high flexural rigidity, the ground reaction load is schematically represented by the graph of FIG. 4, in which reference I has been used to indicate the considerable distance between the two reaction load peaks. The remaining FIGS. 5 and 6 show the reaction load situation in two conventional skis the first with limited rise and high degree of flexibility, and the second with characteristics ranging between those of the first.

Figure 7:
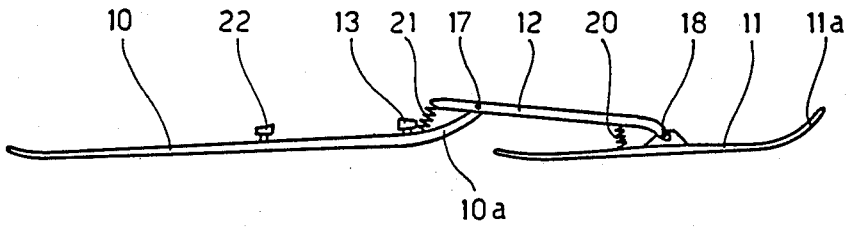
FIG. 7 shows a side view of a first embodiment of a ski according to the invention.
Figure 9:
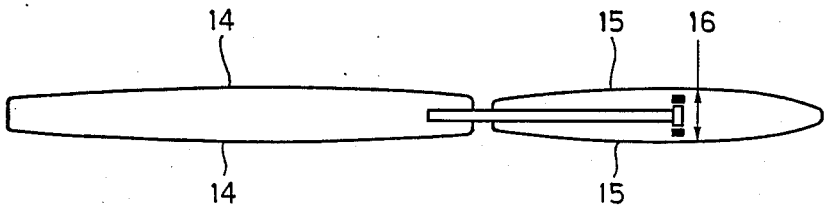
FIG. 9 shows a top view of the skis of FIGS. 8 and 9.

As shown in FIG. 7 unlike the conventional ski of FIG. 1, the ski according to this invention comprises two separate shoes 10, 11 of different lengths aligned according to their longitudinal axis. The two shoes 10 and 11 are connected by mechanical arm 12, movable on a plane perpendicular to the base surface of the shoes; said arm or link member 12 having the function of providing most of the flexural elasticity of the ski, as well as the task of ensuring the utmost torsional rigidity. In particular, as shown in FIG. 7, the ski comprises a main shoe 10, or rear shoe, which extends from the tail to a sufficient portion (100 - 200 mm) ahead of the area designed to house the toe binding 13, with the front end 10*a* of the main shoe 10 slightly curved upwards. The ski comprises a second shoe 11, or front shoe, comparable to the shovel of a conventional ski, having an upward curved tip 11*a*. As shown in the top view of FIG. 9, the profile of the side edges 14 of the rear shoe 10 is preferably slightly convex from one end of the shoe to the other; likewise, the profile of the side edges 15 of the front shoe 11 is fully convex, or "drop-shaped" with a truncated tail, whose point of maximum width 16 is located over half way and in the front portion of the shoe itself.

Figure 10:
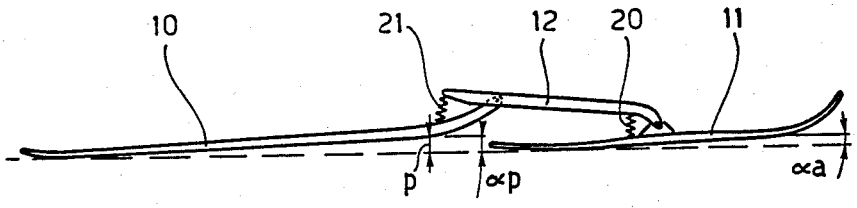
FIG. 10 shows the natural profile in an unloaded condition, of the ski of FIG. 7.
Figure 11:
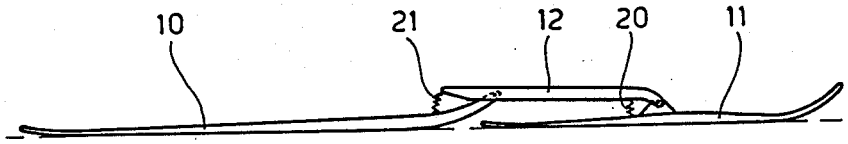
FIG. 11 shows the flattened profile of the ski of FIG. 10, loaded by the weight of the skier.

The two shoes 10 and 11 are connected by means of a rigid or semi-rigid floating arm or link member 12, which is pivoted on side to side transversal axes to the ski, by 17, to the front end of the rear shoe 10, and by 18 to the front shoe 11, in a position to the rear of the point of maximum width of the front shoe. A first motion-limiting spring system 20 which suitably restricts the mobility of the front shoe 11 on said hinge 18 is disposed between the arm 12 and the front shoe 11. A second motion-limiting spring system 21 is disposed between a rear extension of the arm 12 and the rear shoe so as to suitably control the mobility of the arm 12 on the main hinge 17 and, therefore, the rotational traversing movement of the front shoe 11 with respect to the rear or main shoe 10, thereby constituting the elastic deformation of the overall assembly of the two shoes linked together to form a ski. The biasing spring system 20 and 21 each comprise a conventional elastic or compression member, such as a spring or rubber element, which can easily be provided with a conventional load-adjusting member that adjusts the intensity applied by the compression member, as well as a conventional stop member that defines the beginning and the end of the stroke of the compression member, thereby offering the possibility of producing skis with "rise" and flexural rigidity which ca be adjusted according to need (FIGS. 7 and 10). The conventional features of the spring systems 20 and 21 are well-known in the "biased-hinged" art, and are illustrated in FIGS. 7, 8, 10, and 11 by the universal drawing symbol for a spring as referenced by numerals 20 and 21.

Figure 8:
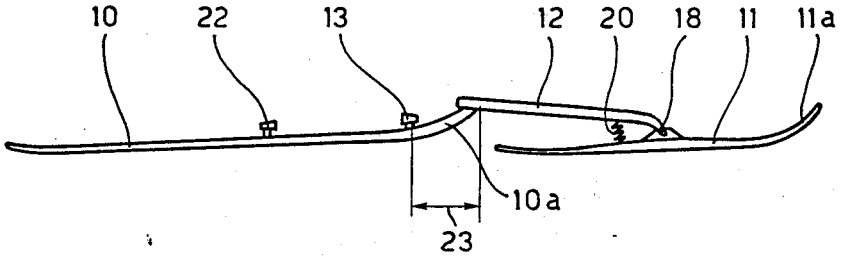
FIG. 8 shows a side view of a second embodiment of a ski according to the invention.

According to the embodiment of FIG. 8, the rear spring system 21 could, if required, be eliminated, and with it the hinge 17, so that the connection between the arm 12 and the rear shoe 10 would become rigid and the elastic function would be entrusted exclusively to the flexibility (suitably provided) of the rear shoe itself, in its projecting portion 23 which extends forward beyond the position of the foot binding 13 (FIG. 8).

Intermediate solutions are obviously possible, so that the flexural elasticity of the ski can be entrusted partly to the flexible projection of the rear shoe 10, as described above, and partly to an independent spring-system, functioning as a "limiter" of the degree of freedom of a hinge, such as the hinge 17 originally provided for the rear shoe.

Figure 12:
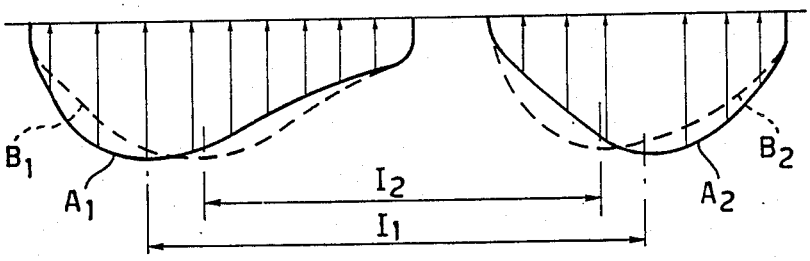
FIG. 12 shows the two reaction load distribution situations for the ski according to the invention.

In any case, the load with which it must be assumed that the ground reacts, when a ski according to the invention is pressed onto it and "flattened" by the weight of the user (FIG. 11) can only be distributed in such a way as to show two distinct areas of maximum concentration: (FIG. 12) one between the heel binding 22 and tail of the rear shoe, in an area which depends upon the intensity of the main spring system 21 and the height of the rise P (the greater the intensity and the height, the further back the area), that is to say, the angle of balance $\alpha p$ formed by the lower face of the rear shoe 10 with the ground, in the "non-loaded" condition, and the other in correspondence with the front pivot 18, whenever (FIGS. 10, 11, 12) the load of the spring system 20 and the angle $\alpha a$ of balance of the front shoe in the "non-loaded" condition are negligible, or immediately behind said hinge whenever such loads ar not at all negligible, the moving back obviously being proportional to their intensity.

The distance I1 or I2 between these areas of maximum concentration must therefore be considered as variable and easily adjustable to a considerable degree. As we have seen, in fact, it is considerable whenever the load of the main spring system 21 and the angle of balance $\alpha p$ of the rear shoe in the "non-loaded" condition (or the rise) are considerable, but at the same time the load of the secondary spring system 20 and the angle of balance $\alpha a$ of the front shoe in the "non-loaded" condition are limited (FIGS. 10, 11, 12), whereas it can be reduced considerably by reducing the load of the main spring system 21 and the angle of balance $\alpha p$ of the rear shoe in the "non-loaded" condition (or the rise), while at the same time intensifying the load of the secondary spring system 20 and the angle of balance $\alpha a$ of the front shoe in the "non-loaded" condition. These two conditions are represented by the curves A1, A2 and B1, B2 of the graph of FIG. 12.

Attention should however be drawn, in this connection, to the undoubtedly considerable proportion (at least half the overall length) that can be reached by the center distance "1" between said points of maximum concentration, similarly to the ski exemplified in FIG. 4, and in correspondence with a substantial absence of the points of maximum concentration (FIGS. 5 and 6) in the hypothetical conventional ski of equal flexural elasticity which can be used as a comparison.

This latter aspect is extremely important in terms of stability of the ski, not only on the straight but also on curves, especially along wide-radius curves, covered at high speed, on frozen or, in any case, hard snow.

In this case, in fact, the ground reacts according to the stress which is not only related to the static weight of the skier but also to the centrifugal force, which is subject to the possibility of rather sudden oscillations of various origin (unevenness of the ground, variations in the slant and speed of the skier, variations in the radius of the curve itself), while the very nature of the ground itself is such as to give rise to continuous and even sudden variations in the conditions and intensity of the grip on the blades. In the conventional ski, this gives rise to a situation of continuous and unexpected changes in the distribution of the reaction load along the inside edge (which should adhere to the line of the curve) and of its own "counterflexed" deformation (FIG. 2) and, therefore, a condition of substantial precariousness and "microinstability" which, on the contrary, does not exist in the case of the ski referred to in this invention, where it must be considered that there are, both on the curve (with the skis "edgewise"), and on the straight (with the skis flat), well defined and spaced apart points of concentration of the load; one around the front hinge 18 and the other on the rear portion of the main shoe 10, with center distance "I" substantially unchanged (in any case, not subject to sudden and recurring variations during the course of the same curve).

Having stated all this with regard to the stability of the ski presented herein, emphasis should likewise be placed on its features of ease of use on curves, or rather, when "reversing the edge" during the transition from one curve to the other, so that it will be clear that the ski of this invention constitutes a valid solution in order to overcome the implicit contradiction of the conventional ski. And, in fact, it is easy to see how a ski thus designed can, when placed "edgewise", or slanted sideways, towards the inside of the programmed curve, spontaneously tend to conform with it as a result of the rotation of the front shoe 11 on its hinge 18, biased by the relative spring system 20 and, above all, in relation to its lateral conformation, where this is the outcome of careful and specific design, having the form of a "truncated drop", with totally convex sides, although obviously only slightly curved), consequently lacking in point of contrary flexure (which is always present in the shovel of a conventional ski, for obvious conjunction requirements), and section of maximum width located sufficiently close to the axis of the hinge 18, which is in turn conveniently situated close to the center line of the portion of the shoe in contact with the ground.

However, in addition to what has been described hereinbefore with regard to the functional features of the invention, stress should also be placed on the industrial aspect which proves to be of even greater interest.

In fact, in a ski of this type, the flexural elastic characteristics depend for the most part upon the mechanical system comprising the arm 12 and the relative spring system 20, 21.

Consequently, the shoes 10 and 11 are no longer required to be flexible, except, partly on the tail portion of the rear shoe 10.

This means that each shoe 10, 11 no longer requires a sandwich structure and can be very inexpensively made in one piece, or by fitting together longitudinal shells, according to injection molding techniques using suitable plastic materials.

This is an extremely important aspect which can revolutionize the production and economic problems of this industrial sector which, to date, encounters intrinsic and unsurmountable obstacles in the way of reducing costs and mass-producing conventional skis while maintaining high standards of quality.

What is claimed is:

1. A double-shoe ski comprising:

a rear shoe having an upwardly-curved front end;

a front shoe having an upwardly-curved front end, said front shoe being longitudinally aligned with and shorter in length than said rear shoe;

intermediate link means connecting said rear shoe and said front shoe and maintaining longitudinal alignment of said front shoe relative to said rear shoe, said link means being hingedly connected to said front shoe to allow pivotal movement of said front shoe only about a side-to-side transverse axis;

foot binding means being mounted on and essentially at the level of said rear shoe, said foot binding means being positioned rearwardly of said intermediate link means; and motion-limiting means, disposed between said link means and said front shoe, for limiting movement of said front shoe relative to said link means.

2. A ski as claimed in claim 1 wherein said front shoe has a midportion which is hingedly connected to said link means.

3. A ski as claimed in claim 2 wherein said rear shoe has a forward portion which is connected to said link means.

4. A ski as claimed in claim 1 wherein said link means is fixedly-connected to said rear shoe.

5. A ski as claimed in claim 4 wherein said link means is hingedly connected at the approximate midpoint between the ends of said front shoe and fixedly-connected to the approximate front end of said rear shoe.

6. A ski as claimed in claim 1 wherein said motion-limiting means comprises: an elastically yielding biasing means for biasing the rear end of said front shoe towards said link means, and a load-adjusting means for adjusting the intensity of said biasing means.

7. A ski as claimed in claim 6 wherein said motion-limiting means further comprises: a stop means for defining the stroke of said biasing means.

8. A ski as claimed in claim 1 wherein said link means is hingedly connected to both of said shoes.

9. A ski as claimed in claim 8 wherein said link means is hingedly-connected at the approximate midpoint between the ends of said front shoe and hingedly-connected to the approximate front end of said rear shoe.

10. A ski as claimed in claim 8 further comprising:

a rear motion-limiting means disposed between said link means and said rear shoe, for limiting movement of said rear shoe relative to said link means;

a front motion-limiting means disposed between said link means and said front shoe, for limiting movement of said front shoe relative to said link means.

11. A ski as claimed in claim 10 wherein the rear end of said link means is provided with a rear extension, and said rear motion-limiting means is disposed between said rear shoe and said rear extension.

12. A ski as claimed in claim 1 wherein said front shoe has convexly-curved side edges.

13. A ski as claimed in claim 12 wherein said link means is hingedly connected at the point of greatest width of the convexly-curved side edges of said front shoe.

14. A ski as claimed in claim 1 wherein said foot binding means is positioned near the front of said rear shoe.

15. A double-shoe ski comprising:

a rear shoe having an upwardly-curved front end;

a front shoe having an upwardly-curved front end, said front shoe being longitudinally aligned with and shorter in length than said rear shoe;

intermediate link means connecting said rear shoe and said front shoe and maintaining longitudinal alignment of said front shoe relative to said rear shoe, said link means being fixedly connected to said rear shoe and hingedly connected to said front shoe to allow pivotal movement of said front shoe only about a side-to-side transverse axis;

foot binding means being mounted on and essentially at the level of said rear shoe, said foot binding means being positioned rearwardly of said intermediate link means; and motion-limiting means disposed between said link means and said front shoe, for limiting movement of said front shoe relative to said link means.

* * * * *